US011011833B2

(12) United States Patent
Huang

(10) Patent No.: US 11,011,833 B2
(45) Date of Patent: May 18, 2021

(54) ANTENNA STRUCTURE AND ELECTRONIC DEVICE

(71) Applicant: Wistron NeWeb Corp., Hsinchu (TW)

(72) Inventor: Chun-Lin Huang, Hsinchu (TW)

(73) Assignee: WISTRON NEWEB CORP., Hsinchu (TW)

( * ) Notice: Subject to any disclaimer, the term of this patent is extended or adjusted under 35 U.S.C. 154(b) by 25 days.

(21) Appl. No.: 16/543,811

(22) Filed: Aug. 19, 2019

(65) Prior Publication Data

US 2020/0067182 A1 Feb. 27, 2020

(30) Foreign Application Priority Data

Aug. 24, 2018 (TW) ..... 107129656

(51) Int. Cl.
*H01Q 1/36* (2006.01)
*H01Q 5/10* (2015.01)
*H01Q 1/22* (2006.01)

(52) U.S. Cl.
CPC ..... *H01Q 1/36* (2013.01); *H01Q 1/22* (2013.01); *H01Q 5/10* (2015.01)

(58) Field of Classification Search
CPC .. H01Q 1/36; H01Q 5/10; H01Q 1/22; H01Q 5/48; H01Q 25/001; H01Q 1/38; H01Q 11/10; H01Q 11/105
See application file for complete search history.

(56) References Cited

U.S. PATENT DOCUMENTS 6,211,839 B1 * 4/2001 Campbell ..... H01Q 1/38 343/792.5
2004/0140942 A1 * 7/2004 Gottl ..... H01Q 13/10 343/810
2008/0111757 A1 * 5/2008 Bisiules ..... H01Q 5/48 343/799
2008/0204343 A1 * 8/2008 Kildal ..... H01Q 11/10 343/792.5

FOREIGN PATENT DOCUMENTS

WO WO-2013000519 A2 * 1/2013 ..... H01Q 11/105

* cited by examiner

*Primary Examiner* — Renan Luque
(74) *Attorney, Agent, or Firm* — McClure, Qualey & Rodack, LLP

(57) ABSTRACT

An antenna structure includes a signal source, four transmission lines, and four radiation elements. The radiation elements are coupled through the transmission lines to the signal source, respectively. Each of the radiation elements includes a loop structure, a first connection element, and a second connection element. The loop structure has a first inner edge and a second inner edge which are opposite to each other. A looped region is formed between the first inner edge and the second inner edge. The looped region has first and second sides. The first connection element extends across the first side of the looped region. The first connection element is coupled between the first inner edge and the second inner edge. The second connection element extends across the second side of the looped region. The second connection element is coupled between the first inner edge and the second inner edge.

20 Claims, 11 Drawing Sheets

810

820

830

ANTENNA STRUCTURE AND ELECTRONIC DEVICE

CROSS REFERENCE TO RELATED APPLICATIONS

This application claims priority of Taiwan Patent Application No. 107129656 filed on Aug. 24, 2018, the entirety of which is incorporated by reference herein.

BACKGROUND OF THE INVENTION

Field of the Invention

The disclosure generally relates to an antenna structure, and more particularly, it relates to a wideband antenna structure.

Description of the Related Art

With the advancements being made in mobile communication technology, mobile devices such as portable computers, mobile phones, multimedia players, and other hybrid functional portable electronic devices have become more common. To satisfy user demand, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, 2500 MHz, and 2700 MHz. Some devices cover a small wireless communication area; these include mobile phones using Wi-Fi and Bluetooth systems and using frequency bands of 2.4 GHz, 5.2 GHz, and 5.8 GHz.

Antennas are indispensable elements in the field of wireless communication. In order to effectively increase the data transmission speed of mobile devices, it has become a critical challenge for current designers to design a new antenna structure with wideband and high-gain characteristics.

BRIEF SUMMARY OF THE INVENTION

In an exemplary embodiment, the invention is directed to an antenna structure including a signal source, a first transmission line, a second transmission line, a third transmission line, a fourth transmission line, a first radiation element, a second radiation element, a third radiation element, and a fourth radiation element. The first radiation element is coupled through the first transmission line to the signal source. The second radiation element is coupled through the second transmission line to the signal source. The third radiation element is coupled through the third transmission line to the signal source. The fourth radiation element is coupled through the fourth transmission line to the signal source. Each of the first radiation element, the second radiation element, the third radiation element, and the fourth radiation element includes a loop structure, a first connection element, and a second connection element. The loop structure has a first inner edge and a second inner edge which are opposite to each other. A looped region is formed between the first inner edge and the second inner edge. The first connection element extends across a first side of the looped region. The first connection element is coupled between the first inner edge and the second inner edge. The second connection element extends across a second side of the looped region. The second connection element is coupled between the first inner edge and the second inner edge. The second side is opposite to the first side. The first connection element and the second connection element are symmetrically positioned.

In another exemplary embodiment, the invention is directed to an electronic device including a housing and an antenna structure. The antenna structure is disposed in the housing. The antenna structure includes a signal source, a first transmission line, a second transmission line, a third transmission line, a fourth transmission line, a first radiation element, a second radiation element, a third radiation element, and a fourth radiation element. The first radiation element is coupled through the first transmission line to the signal source. The second radiation element is coupled through the second transmission line to the signal source. The third radiation element is coupled through the third transmission line to the signal source. The fourth radiation element is coupled through the fourth transmission line to the signal source. The first radiation element includes a loop structure, a first connection element, and a second connection element. The loop structure has a first inner edge and a second inner edge which are opposite to each other with respect to a virtual extension line. The virtual extension line is substantially perpendicular to a central extension line of the first transmission line. A looped region is formed between the first inner edge and the second inner edge. The first connection element extends across a first side of the looped region. The first connection element is coupled between the first inner edge and the second inner edge. The second connection element extends across a second side of the looped region. The second connection element is coupled between the first inner edge and the second inner edge. The second side is opposite to the first side. The first connection element and the second connection element are symmetrically arranged with respect to the central extension axis of the first transmission line.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the purposes, features and advantages of the invention, the embodiments and figures of the invention are shown in detail as follows.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

Figure 1:
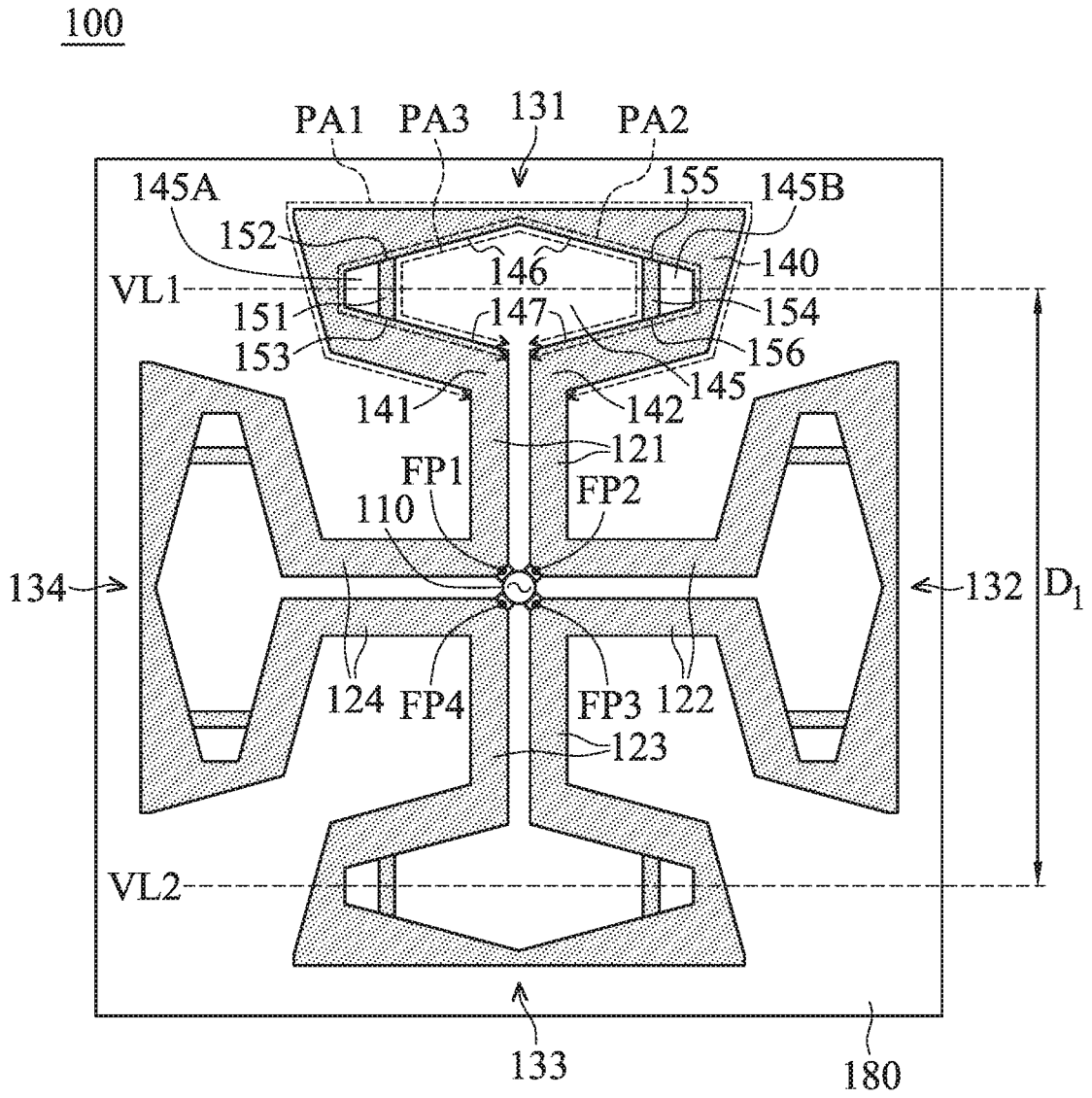
FIG. 1 is a diagram of an antenna structure according to an embodiment of the invention.

FIG. 1 is a diagram of an antenna structure 100 according to an embodiment of the invention. For example, the antenna structure 100 may be used as an external antenna of a mobile device or a desktop computer. As shown in FIG. 1, the antenna structure 100 at least includes a signal source 110, a first transmission line 121, a second transmission line 122, a third transmission line 123, a fourth transmission line 124, a first radiation element 131, a second radiation element 132, a third radiation element 133, and a fourth radiation element 134. The signal source 110 may be an RF (Radio Frequency) module for generating a transmission signal or processing a reception signal. The first transmission line 121, the second transmission line 122, the third transmission line 123, the fourth transmission line 124, the first radiation element 131, the second radiation element 132, the third radiation element 133, and the fourth radiation element 134 may be made of metal materials, such as copper, silver, aluminum, iron, or their alloys.

In some embodiments, the antenna structure 100 further includes a dielectric substrate 180 for disposing the first transmission line 121, the second transmission line 122, the third transmission line 123, the fourth transmission line 124, the first radiation element 131, the second radiation element 132, the third radiation element 133, and the fourth radiation element 134. For example, the dielectric substrate 180 may be a PCB (Printed Circuit Board), an FR4 (Flame Retardant 4) substrate, or a FCB (Flexible Circuit Board). The existence of the dielectric substrate 180 can minimize the total size of the antenna structure 100. In alternative embodiments, the dielectric substrate 180 is removable from the antenna structure 100.

Each of the first radiation element 131, the second radiation element 132, the third radiation element 133, and the fourth radiation element 134 is coupled through a respective one of the first transmission line 121, the second transmission line 122, the third transmission line 123, and the fourth transmission line 124 to the signal source 110. It should be noted that the shapes and types of the first transmission line 121, the second transmission line 122, the third transmission line 123, and the fourth transmission line 124 are not limited in the invention. For example, each of the first transmission line 121, the second transmission line 122, the third transmission line 123, and the fourth transmission line 124 may be implemented with a microstrip line, a stripline, or a CPW (Coplanar Waveguide), but it is not limited thereto.

In some embodiments, each of the first transmission line 121, the second transmission line 122, the third transmission line 123, and the fourth transmission line 124 includes a pair of conductive lines, which are adjacent to and substantially parallel each other. The first radiation element 131 is coupled through the pair of conductive lines of the first transmission line 121 to a first feeding point FP1 and a second feeding point FP2, respectively. The second radiation element 132 is coupled through the pair of conductive lines of the second transmission line 122 to the second feeding point FP2 and a third feeding point FP3, respectively. The third radiation element 133 is coupled through the pair of conductive lines of the third transmission line 123 to the third feeding point FP3 and a fourth feeding point FP4, respectively. The fourth radiation element 134 is coupled through the pair of conductive lines of the fourth transmission line 124 to the first feeding point FP1 and the fourth feeding point FP4, respectively. Specifically, the signal source 110 may have a first positive electrode, a second positive electrode, a first negative electrode, and a second negative electrode. The first positive electrode may be coupled to the first feeding point FP1. The second positive electrode may be coupled to the fourth feeding point FP4. The first negative electrode may be coupled to the second feeding point FP2. The second negative electrode may be coupled to the third feeding point FP3. According to practical measurements, the antenna structure 100 with such a feeding arrangement can provide a dual-polarized radiation pattern (e.g., having both±45-degrees polarization directions). In alternative embodiments, the connection relationship between the signal source 110 and the aforementioned four feeding points is adjustable according to different polarization requirements.

In some embodiments, the first radiation element 131, the second radiation element 132, the third radiation element 133, the fourth radiation element 134, the first transmission line 121, the second transmission line 122, the third transmission line 123, and the fourth transmission line 124 are symmetrically distributed with respect to a central point of the antenna structure 100 (the central point may locate at the signal source 110), such that the antenna structure 100 may radiate with a nearly omnidirectional radiation pattern. In other words, the first radiation element 131, the second radiation element 132, the third radiation element 133, and the fourth radiation element 134 have the same structures, but they are arranged toward difference directions. The following embodiments and figures will illustrate the detailed structure of each radiation element, using the first radiation element 131 as an exemplary embodiment.

Each of the first radiation element 131, the second radiation element 132, the third radiation element 133, and the fourth radiation element 134 includes a loop structure 140, a first connection element 151, and a second connection element 154. For example, a first end 141 and a second end 142 of the loop structure 140 of the first radiation element 131 may be coupled to the pair of conductive lines of the first transmission line 121, respectively, such that the first radiation element 131 is excited by the signal source 110. In addition, the loop structure 140, the first connection element 151, and the second connection element 154 of the first radiation element 131 are symmetrically disposed with respect to a central extension axis of the first transmission line 121. The loop structure 140 has a first inner edge 146 and a second inner edge 147 which are opposite to each other. A looped region 145 is formed between the first inner edge 146 and the second inner edge 147. That is, the first inner edge 146 and the second inner edge 147 are considered as a first outer edge and a second outer edge of the looped region 145, which are opposite to each other. Each of the first connection element 151 and the second connection element 154 may substantially have a straight-line shape. The first connection element 151 and the second connection element 154 may be separated from each other, and may be substantially symmetrical and parallel to each other as well. The first connection element 151 and the second connection element 154 may have the same length. The looped region 145 has a first side 145A and a second side 145B opposite to each other. The first connection element 151 extends across the first side 145A of the looped region 145. The first connection element 151 is coupled between the first inner edge 146 and the second inner edge 147. The second connection element 154 extends across the second side 145B of the looped region 145. The second connection element 154 is coupled between the first inner edge 146 and the second inner edge 147. Specifically, a first end 152 of the first connection element 151 and a first end 155 of the second connection element 154 are coupled to different positions on the first inner edge 146, and a second end 153 of the first connection element 151 and a second end 156 of the second connection element 154 are coupled to different positions on the second inner edge 147.

Figure 2:
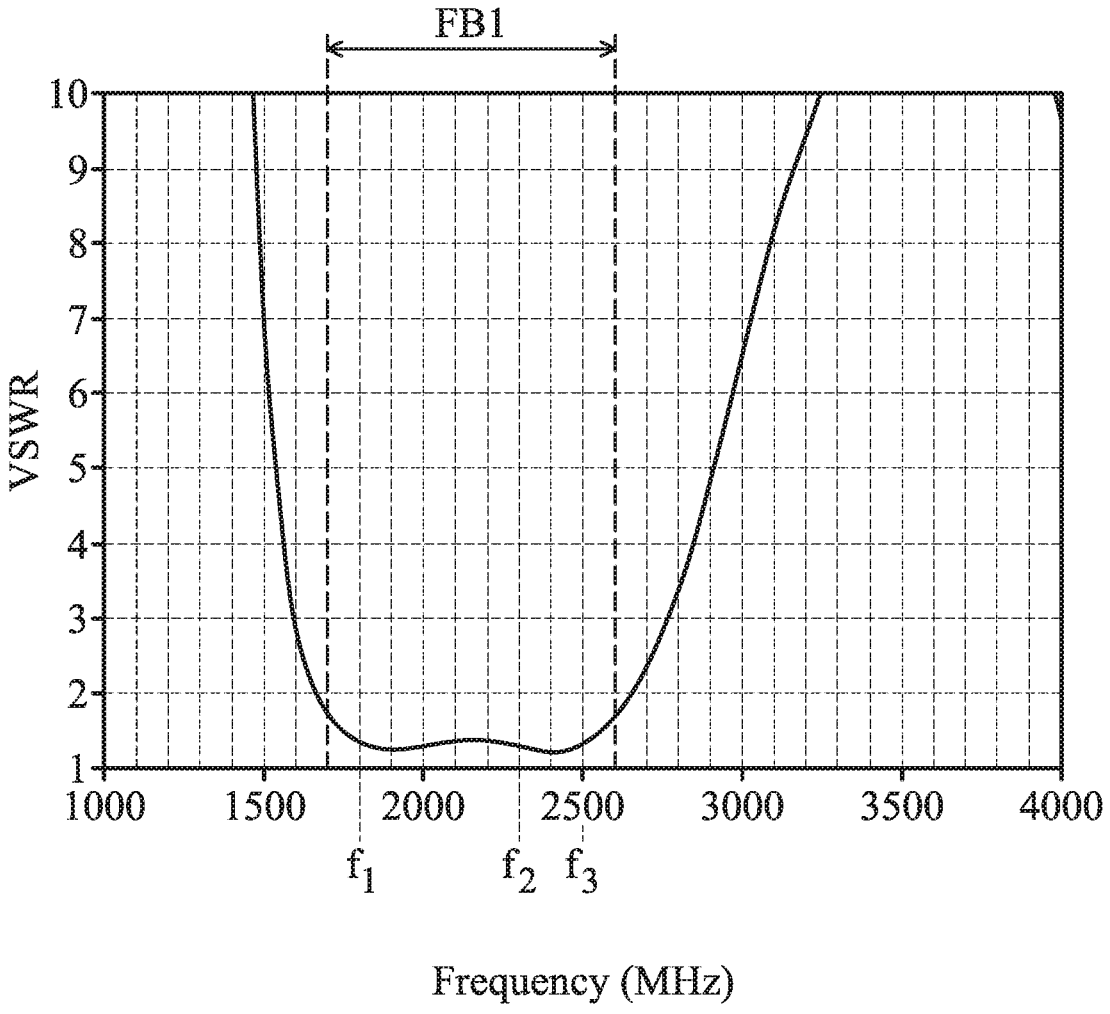
FIG. 2 is a diagram of VSWR (Voltage Standing Wave Ratio) of an antenna structure according to an embodiment of the invention.

FIG. 2 is a diagram of VSWR (Voltage Standing Wave Ratio) of the antenna structure 100 according to an embodiment of the invention. According to the measurement of FIG. 2, the antenna structure 100 can cover an operation frequency band FB1 which at least includes a first resonant frequency $f_1$, a second resonant frequency $f_2$, and a third resonant frequency $f_3$ in a low-to-high order. For example, the operation frequency band FB1 may be from 1700 MHz to 2600 MHz, the first resonant frequency $f_1$ may be about 1800 MHz, the second resonant frequency $f_2$ may be about 2300 MHz, and the third resonant frequency $f_3$ may be about 2500 MHz, but they are not limited thereto.

In some embodiments, the operation principle and the element sizes of the antenna structure 100 are as follows. Initially, a first resonant path PA1 is formed along the outer periphery of the loop structure 140, and the first resonant path PA1 is excited to generate the first resonant frequency $f_1$. The length of the first resonant path PA1 is calculated according to the equation (1).

$$L_1 = \frac{c \cdot k}{f_1 \cdot \sqrt[6]{\varepsilon_r}} \tag{1}$$

where "$L_1$" represents the length of the first resonant path PA1, "c" represents speed of light, "$f_1$" represents the first resonant frequency $f_1$, "$\varepsilon_r$" represents a dielectric constant of the dielectric substrate 180, and "k" represents a compensation constant from 0.8 to 1.2.

Next, a second resonant path PA2 is formed along the inner periphery of the loop structure 140 (i.e., the outer periphery of the looped region 145, which includes the first inner edge 146 and the second inner edge 147 but is not limited thereto), and the second resonant path PA2 is excited to generate the second resonant frequency $f_2$. The length of the second resonant path PA2 is calculated according to the equation (2).

$$L_2 = \frac{c \cdot k}{f_2 \cdot \sqrt[6]{\varepsilon_r}} \tag{2}$$

where "$L_2$" represents the length of the second resonant path PA2, "c" represents the speed of light, "$f_2$" represents the second resonant frequency $f_2$, "$\varepsilon_r$" represents the dielectric constant of the dielectric substrate 180, and "k" represents the compensation constant from 0.8 to 1.2.

Furthermore, a third resonant path PA3 is formed along the first inner edge 146, the first connection element 151, the second inner edge 147, and the second connection element 154, and the third resonant path PA3 is excited to generate the third resonant frequency $f_3$. The length of the third resonant path PA3 is calculated according to the equation (3).

$$L_3 = L_2 \cdot \left[1 - \left(\frac{f_3}{f_2} - 1\right) \cdot 2\right] \cdot k \tag{3}$$

where "$L_3$" represents the length of the third resonant path PA3, "$L_2$" represents the length of the second resonant path PA2, "$f_3$" represents the third resonant frequency $f_3$, "$f_2$" represents the second resonant frequency $f_2$, and "k" represents the compensation constant from 0.8 to 1.2.

As mentioned above, the length of the third resonant path PA3 is derived from the length of the second resonant path PA2 and the second resonant frequency $f_2$. Specifically, the length of the third resonant path PA3 is the total length of the following elements: the first connection element 151, the second connection element 154, the portion of the first inner edge 146 which is positioned between the first end 152 of the first connection element 151 and the first end 155 of the second connection element 154, and the portion of the second inner edge 147 which is positioned between the second end 153 of the first connection element 151 and the second end 156 of the second connection element 154. It should be noted that the length of the gap between the first end 141 and the second end 142 of the loop structure 140 is negligible.

In addition, the distance $D_1$ between any opposite two of the first radiation element 131, the second radiation element 132, the third radiation element 133, and the fourth radiation element 134 (e.g., the distance between the central point of the first radiation element 131 and the central point of the third radiation element 133) is calculated according to the equation (4).

$$D_1 = \frac{c \cdot k}{2 \cdot f_c} \tag{4}$$

where "$D_1$" represents the distance $D_1$, "c" represents the speed of light, "$f_c$" represents the central frequency of the operation frequency band FB1 of the antenna structure 100, and "k" represents the compensation constant from 0.8 to 1.2. In some embodiments, the aforementioned distance $D_1$ is defined as follows. A first virtual extension line (e.g., the first virtual extension line VL1) is formed by connecting the central point of the first connection element 151 to the central point of the second connection element 154 among one radiation element (e.g., one of the radiation elements 131, 132, 133 and 134, such as the first radiation element 131). A second virtual extension line (e.g., the second virtual extension line VL2) is formed by connecting the central point of the first connection element 151 to the central point of the second connection element 154 among another radiation element which is opposite to the aforementioned radiation element (e.g., another of the radiation elements 131, 132, 133 and 134, such as the third radiation element 133). The distance D1 is equal to the distance between the first virtual extension line and the second virtual extension line.

For example, if the operation frequency band FB1 has a lower limit of 1700 MHz and an upper limit of 2600 MHz, the central frequency $f_c$ may be equal to an average value 2150 MHz of the 1700 MHz and the 2600 MHz. The central frequency $f_c$ may be adjustable according to the range of the operation frequency band FB1 of the antenna structure 100. It should be noted that the above ranges of elements are calculated and obtained according to many experiment results, and they help to optimize the operation bandwidth, the impedance matching, and the radiation gain of the antenna structure 100.

Figure 3:
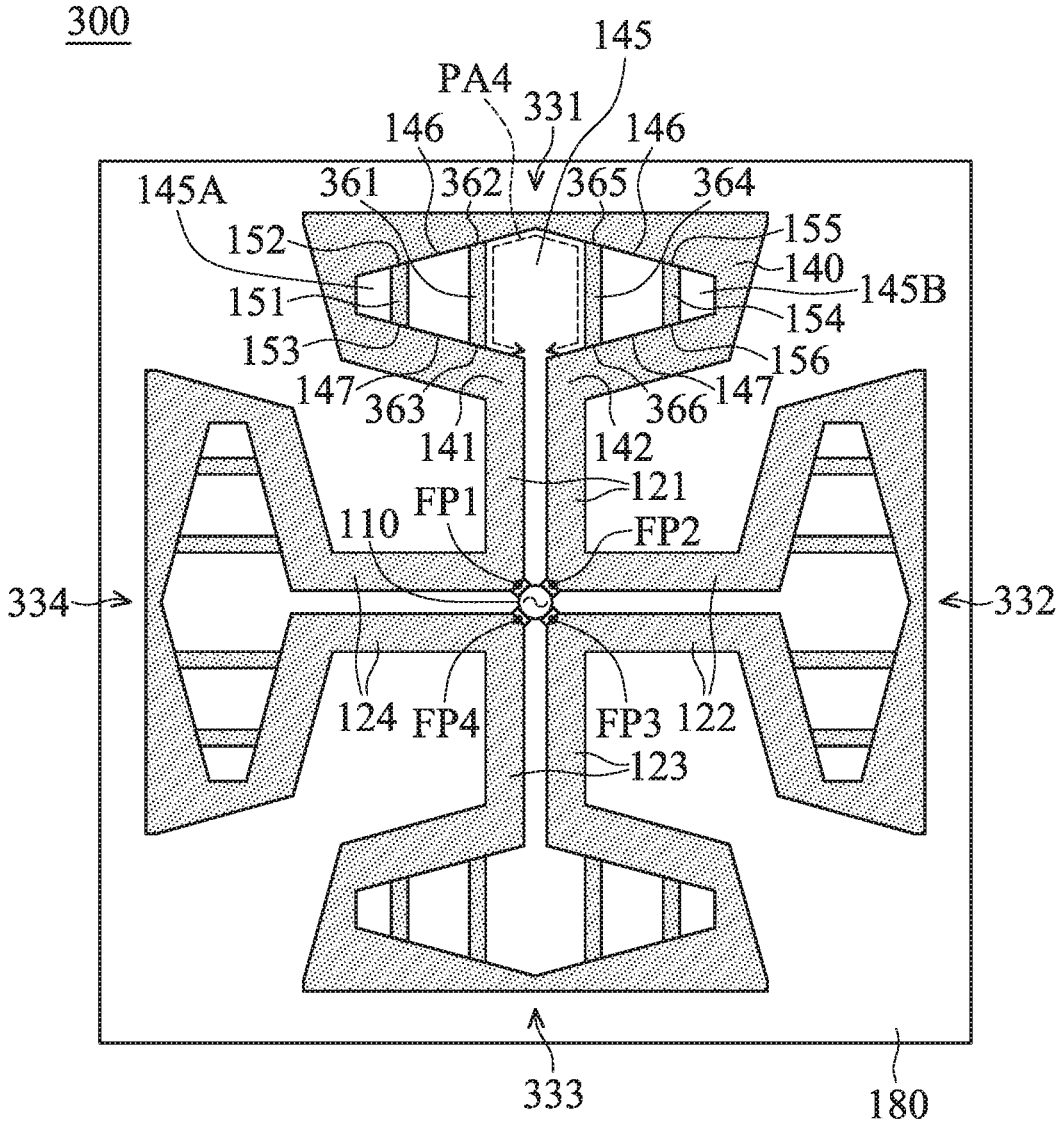
FIG. 3 is a diagram of an antenna structure according to another embodiment of the invention.

FIG. 3 is a diagram of an antenna structure 300 according to another embodiment of the invention. FIG. 3 is similar to FIG. 1. In the embodiment of FIG. 3, each of a first radiation element 331, a second radiation element 332, a third radiation element 333, and a fourth radiation element 334 of the antenna structure 300 further includes a third connection element 361 and a fourth connection element 364. For example, the third connection element 361 and the fourth connection element 364 of the first radiation element 331 may be both positioned between the first connection element 151 and the second connection element 154 of the first radiation element 331. The loop structure 140, the third connection element 361, and the fourth connection element 364 of the first radiation element 331 are symmetrically arranged with respect to the central extension axis of the first transmission line 121. Each of the third connection element 361 and the fourth connection element 364 may substantially have a straight-line shape. The third connection element 361 and the fourth connection element 364 may be separate from each other, and may be substantially symmetrical and parallel to each other as well. The third connection element 361 and the fourth connection element 364 may have the same length. The third connection element 361 extends across the first side 145A of the looped region 145. The third connection element 361 is coupled between the first inner edge 146 and the second inner edge 147. The fourth connection element 364 extends across the second side 145B of the looped region 145. The fourth connection element 364 is coupled between the first inner edge 146 and the second inner edge 147. Specifically, a first end 362 of the third connection element 361 and a first end 365 of the fourth connection element 364 are coupled to different positions on the first inner edge 146, and a second end 363 of the third connection element 361 and a second end 366 of the fourth connection element 364 are coupled to different positions on the second inner edge 147. In some embodiments, the length of the third connection element 361 is longer than or equal to the length of the first connection element 151, and the length of the fourth connection element 364 is longer than or equal to the length of the second connection element 154.

Figure 4:
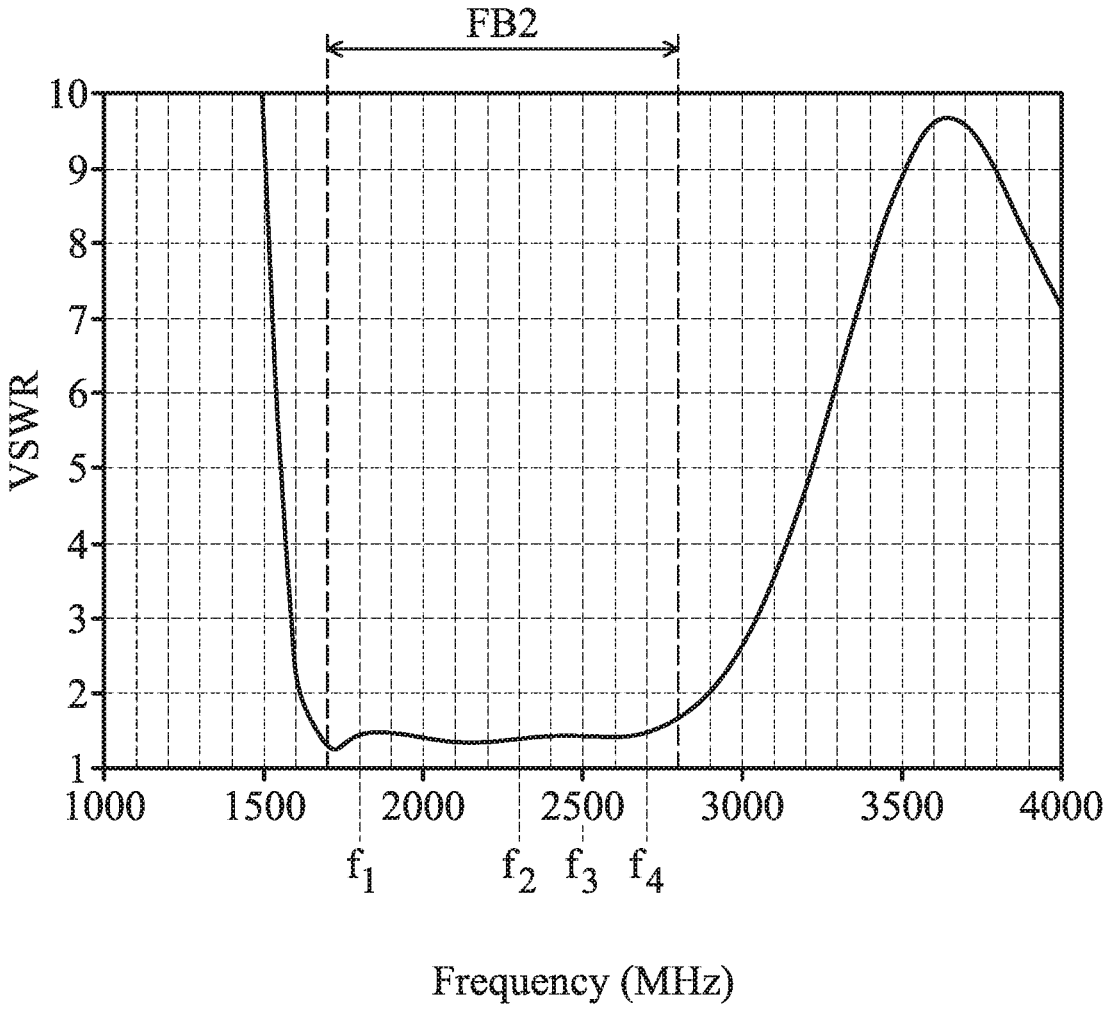
FIG. 4 is a diagram of VSWR of an antenna structure according to another embodiment of the invention.

FIG. 4 is a diagram of VSWR of the antenna structure 300 according to another embodiment of the invention. According to the measurement of FIG. 4, the antenna structure 300 can cover an operation frequency band FB2 that further includes a fourth resonant frequency $f_4$. For example, the operation frequency band FB2 may be from 1700 MHz to 2800 MHz, and the fourth resonant frequency $f_4$ may be about 2700 MHz, but they are not limited thereto. Regarding the operation principle of the antenna structure 300, a fourth resonant path PA4 is further formed along the first inner edge 146, the third connection element 361, the second inner edge 147, and the fourth connection element 364, and the fourth resonant path PA4 is excited to generate the fourth resonant frequency $f_4$. The length of the fourth resonant path PA4 is calculated according to the equation (5).

$$L_4 = L_3 \cdot \left[1 - \left(\frac{f_4}{f_3} - 1\right) \cdot 4\right] \cdot k \tag{5}$$

where "$L_4$" represents the length of the fourth resonant path PA4, "$L_3$" represents the length of the third resonant path PA3, "$f_4$" represents the fourth resonant frequency $f_4$, "$f_3$" represents the third resonant frequency $f_3$, and "k" represents the compensation constant from 0.8 to 1.2.

As mentioned above, the length of the fourth resonant path PA4 is derived from the length of the third resonant path PA3 and the third resonant frequency $f_3$. Specifically, the length of the fourth resonant path PA4 is the total length of the following elements: the third connection element 361, the fourth connection element 364, the portion of the first inner edge 146 which is positioned between the first end 362 of the third connection element 361 and the first end 365 of the fourth connection element 364, and the portion of the second inner edge 147 which is positioned between the second end 363 of the third connection element 361 and the second end 366 of the fourth connection element 364. The length of the gap between the first end 141 and the second end 142 of the loop structure 140 is negligible. According to the measurement of FIG. 4, if the third connection element 361 and the fourth connection element 364 are added into the antenna structure 300, the fourth resonant frequency $f_4$ may be additionally generated, so as to effectively increase the bandwidth of the operation frequency band FB2 of the antenna structure 300. Other features of the antenna structure 300 of FIG. 3 are similar to those of the antenna structure 100 of FIG. 1. Accordingly, the two embodiments can achieve similar levels of performance.

Figure 5:
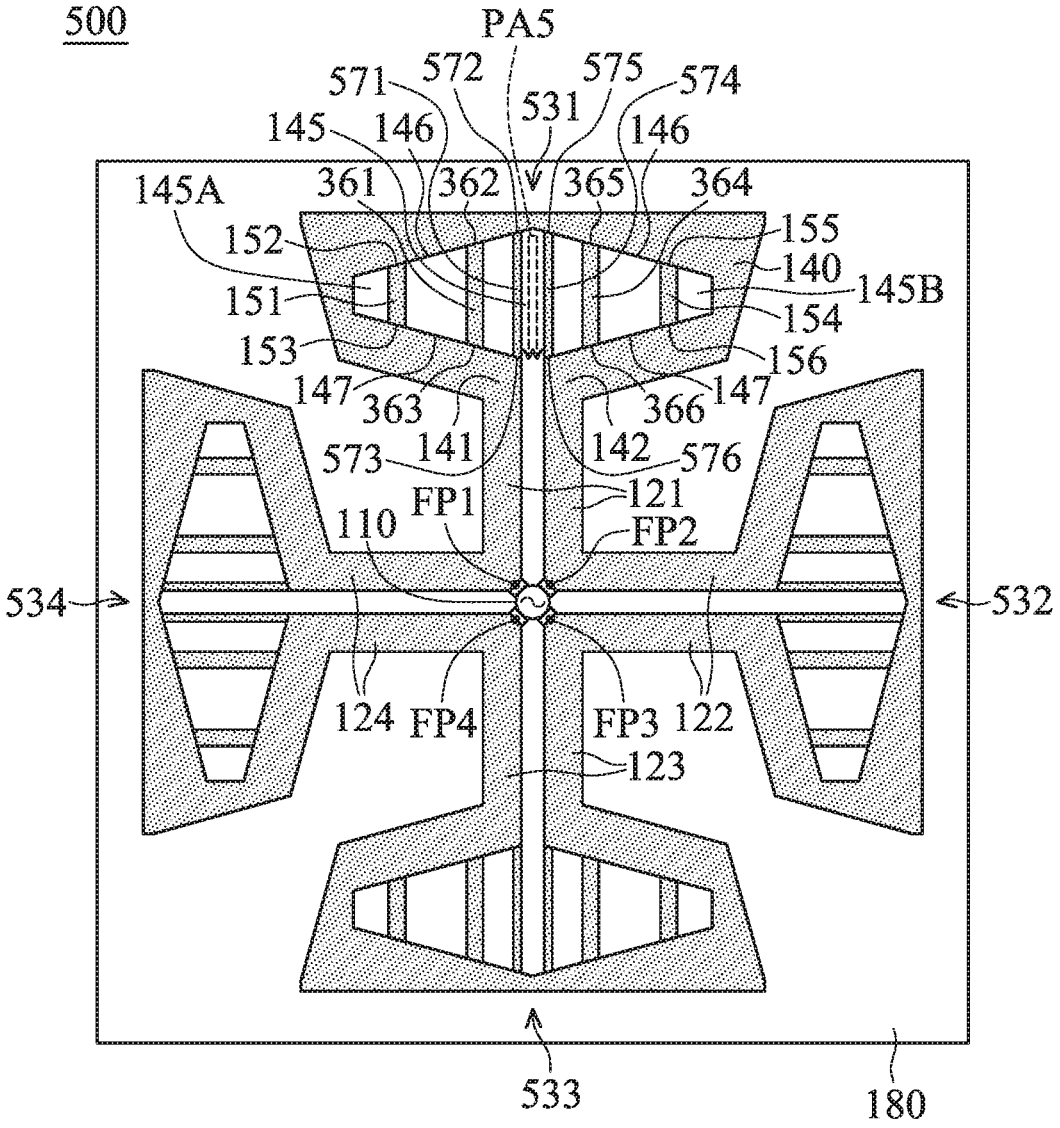
FIG. 5 is a diagram of an antenna structure according to another embodiment of the invention.

FIG. 5 is a diagram of an antenna structure 500 according to another embodiment of the invention. FIG. 5 is similar to FIG. 3. In the embodiment of FIG. 5, each of a first radiation element 531, a second radiation element 532, a third radiation element 533, and a fourth radiation element 534 of the antenna structure 500 further includes a fifth connection element 571 and a sixth connection element 574. For example, the fifth connection element 571 and the sixth connection element 574 of the first radiation element 531 may be both positioned between the third connection element 361 and the fourth connection element 364 of the first radiation element 531. The loop structure 140, the fifth connection element 571, and the sixth connection element 574 of the first radiation element 531 are symmetrically arranged with respect to the central extension axis of the first transmission line 121. Each of the fifth connection element 571 and the sixth connection element 574 may substantially have a straight-line shape. The fifth connection element 571 and the sixth connection element 574 may be separated, i.e. spaced apart from each other, and may be substantially symmetrical and parallel to each other as well. The fifth connection element 571 and the sixth connection element 574 may have the same lengths. The fifth connection element 571 extends across the first side 145A of the looped region 145. The fifth connection element 571 is coupled between the first inner edge 146 and the second inner edge 147. The sixth connection element 574 extends across the second side 145B of the looped region 145. The sixth connection element 574 is coupled between the first inner edge 146 and the second inner edge 147. Specifically, a first end 572 of the fifth connection element 571 and a first end 575 of the sixth connection element 574 are coupled to different positions on the first inner edge 146, and a second end 573 of the fifth connection element 571 and a second end 576 of the sixth connection element 574 are coupled to different positions on the second inner edge 147. In some embodiments, the length of the fifth connection element 571 is longer than or equal to the length of the third connection element 361, and the length of the sixth connection element 574 is longer than or equal to the length of the fourth connection element 364.

Figure 6:
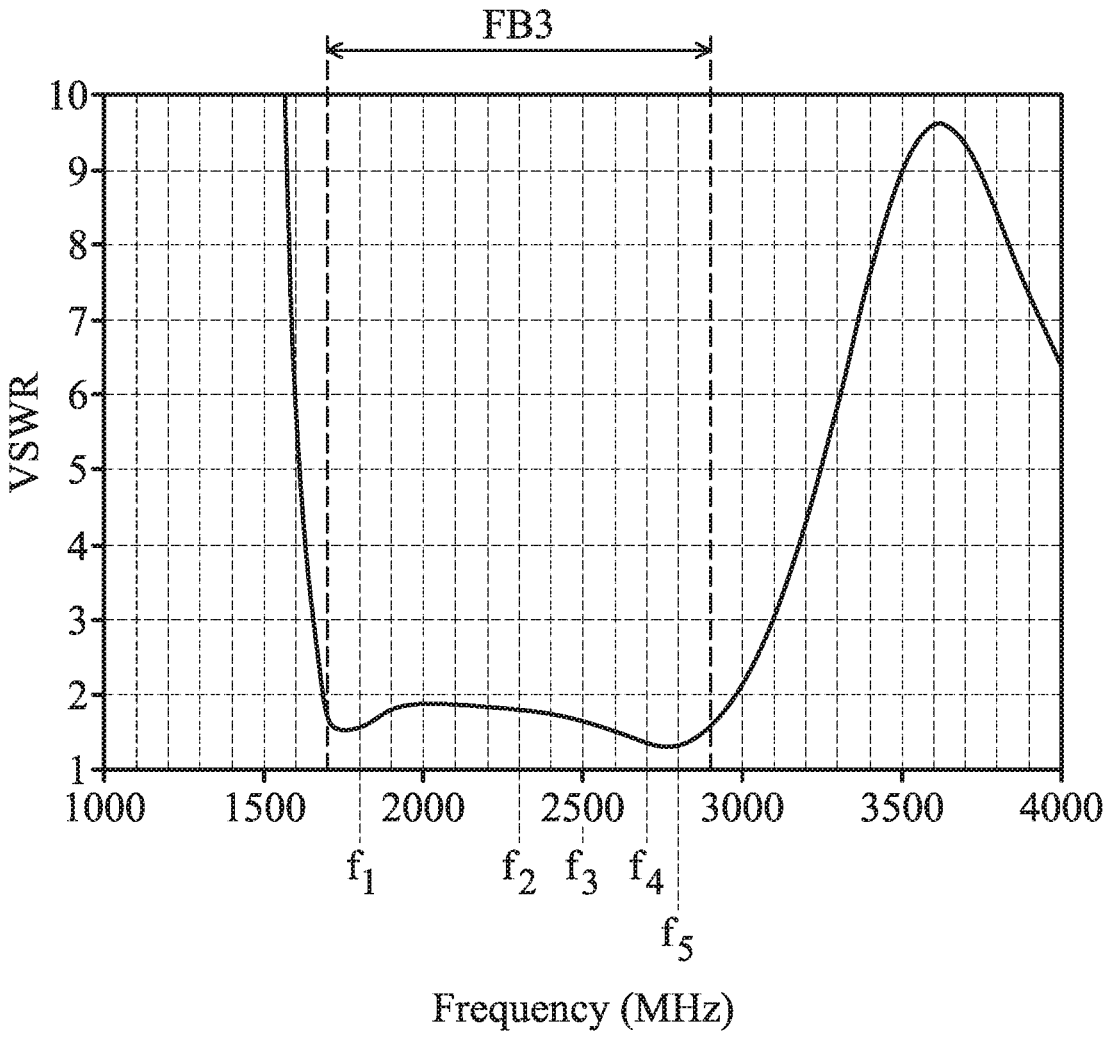
FIG. 6 is a diagram of VSWR of an antenna structure according to another embodiment of the invention.

FIG. 6 is a diagram of VSWR of the antenna structure 500 according to another embodiment of the invention. According to the measurement of FIG. 6, the antenna structure 500 can cover an operation frequency band FB3 which further includes a fifth resonant frequency $f_5$. For example, the operation frequency band FB3 may be from 1700 MHz to 2900 MHz, and the fifth resonant frequency $f_5$ may be about 2800 MHz, but they are not limited thereto. Regarding the operation principle of the antenna structure 500, a fifth resonant path PA5 is further formed along the first inner edge 146, the fifth connection element 571, the second inner edge 147, and the sixth connection element 574, and the fifth resonant path PA5 is excited to generate the fifth resonant frequency $f_5$. The length of the fifth resonant path PA5 is calculated according to the equation (6).

$$L_5 = L_4 \cdot \left[1 - \left(\frac{f_5}{f_4} - 1\right) \cdot 8\right] \cdot k \tag{6}$$

where "$L_5$" represents the length of the fifth resonant path PA5, "$L_4$" represents the length of the fourth resonant path PA4, "$f_5$" represents the fifth resonant frequency $f_5$, "$f_4$" represents the fourth resonant frequency $f_4$, and "k" represents the compensation constant from 0.8 to 1.2.

As mentioned above, the length of the fifth resonant path PA5 is derived from the length of the fourth resonant path PA4 and the fourth resonant frequency $f_4$. Specifically, the length of the fifth resonant path PA5 is the total length of the following elements: the fifth connection element 571, the sixth connection element 574, the portion of the first inner edge 146 which is positioned between the first end 572 of the fifth connection element 571 and the first end 575 of the sixth connection element 574, and the portion of the second inner edge 147 which is positioned between the second end 573 of the fifth connection element 571 and the second end 576 of the sixth connection element 574. The length of the gap between the first end 141 and the second end 142 of the loop structure 140 is negligible. According to the measurement of FIG. 6, if the fifth connection element 571 and the sixth connection element 574 are added into the antenna structure 500, the fifth resonant frequency $f_5$ may be additionally generated, so as to effectively increase the bandwidth of the operation frequency band FB3 of the antenna structure 500. Other features of the antenna structure 500 of FIG. 5 are similar to those of the antenna structure 300 of FIG. 3. Accordingly, the two embodiments can achieve similar levels of performance.

In alternative embodiments, the antenna structure 500 includes more pairs of connection elements for forming the first resonant path to the N-th resonant path (not shown). Generally, the N-th resonant path is excited to generate the N-th resonant frequency $f_N$. The length of the N-th resonant path is calculated according to the equation (7).

$$L_N = L_{N-1} \cdot \left[1 - \left(\frac{f_N}{f_{N-1}} - 1\right) \cdot 2^{(N-2)}\right] \cdot k \tag{7}$$

where "$L_N$" represents the length of the N-th resonant path, "$L_{N-1}$" represents the length of the N−1-th resonant path, "$f_N$" represents the N-th resonant frequency $f_N$, "$f_{N-1}$" represents the N−1-th resonant frequency $f_{N-1}$, "k" represents the compensation constant from 0.8 to 1.2, and "N" is a positive integer which is greater than or equal to 3.

Figure 7:
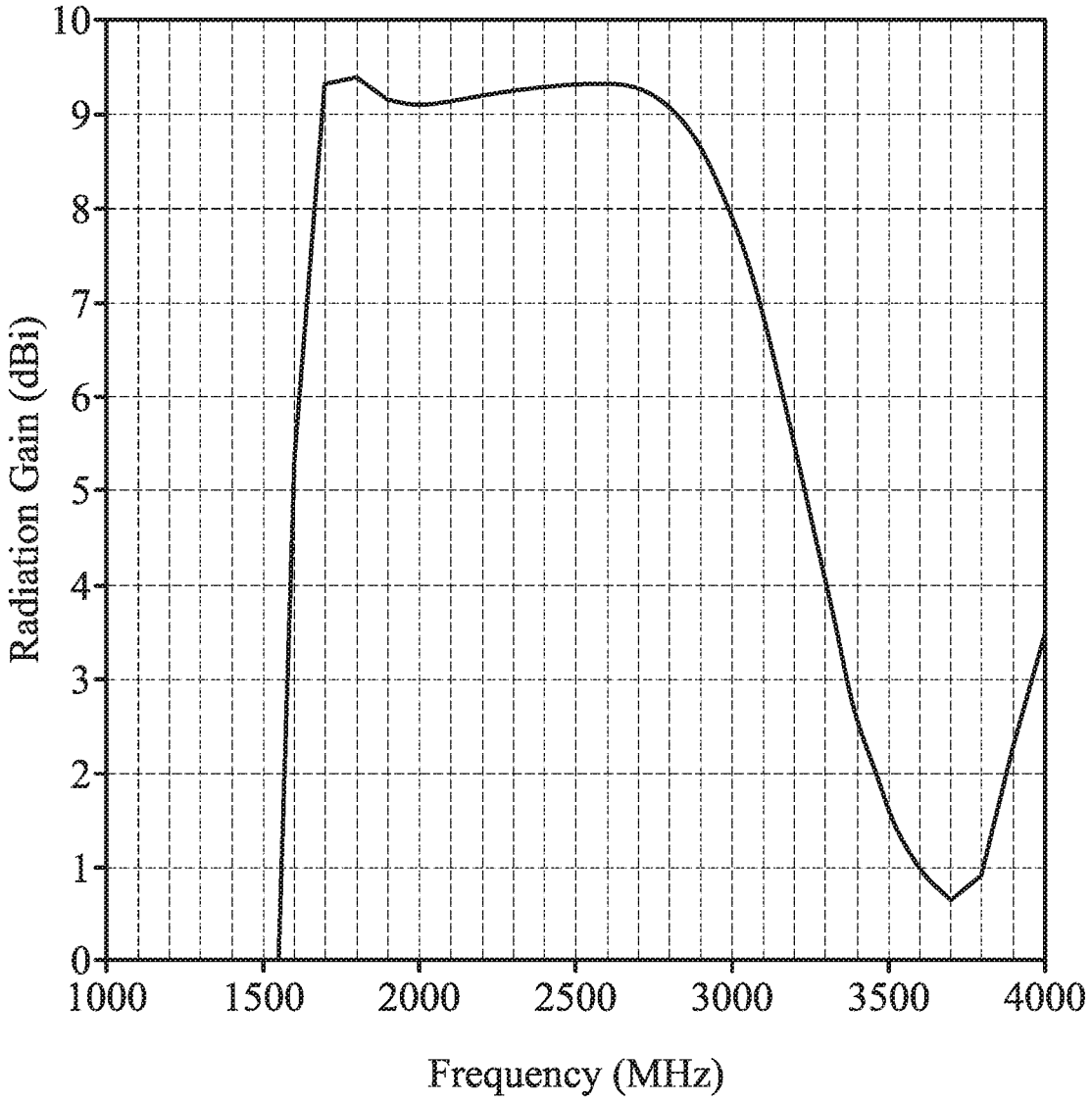
FIG. 7 is a diagram of radiation gain of an antenna structure according to another embodiment of the invention.

FIG. 7 is a diagram of radiation gain of the antenna structure 500 according to another embodiment of the invention. According to the measurement of FIG. 7, the radiation gain of the antenna structure 500 is almost greater than 9 dBi within the operation frequency band FB3 (from 1700 MHz to 2900 MHz), and it can meet the requirement of practical application of general mobile communication devices.

Figure 8A:
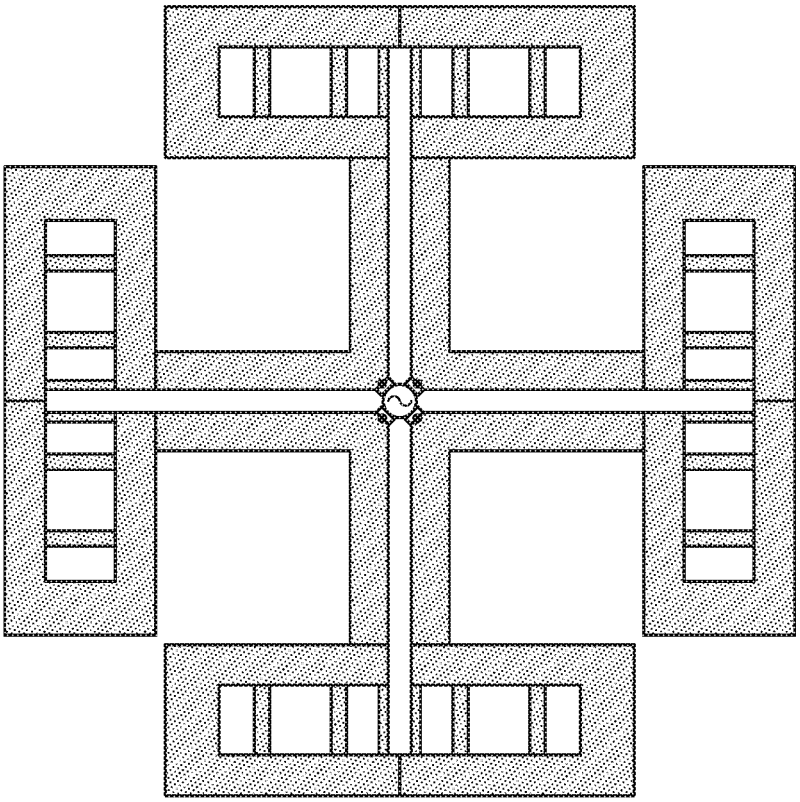
FIG. 8A is a diagram of an antenna structure according to another embodiment of the invention.
Figure 8B:
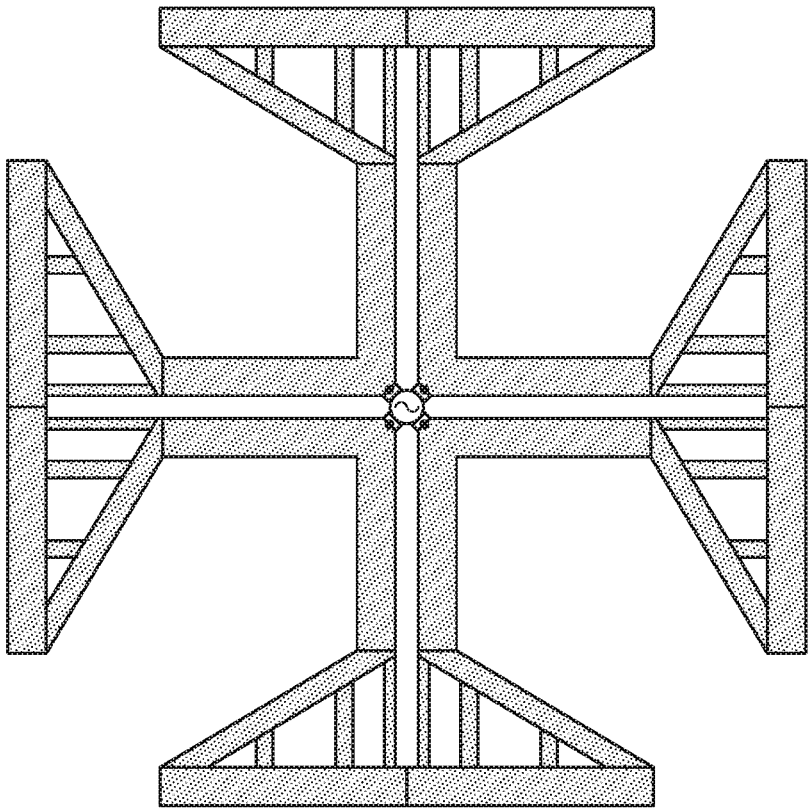
FIG. 8B is a diagram of an antenna structure according to another embodiment of the invention.
Figure 8C:
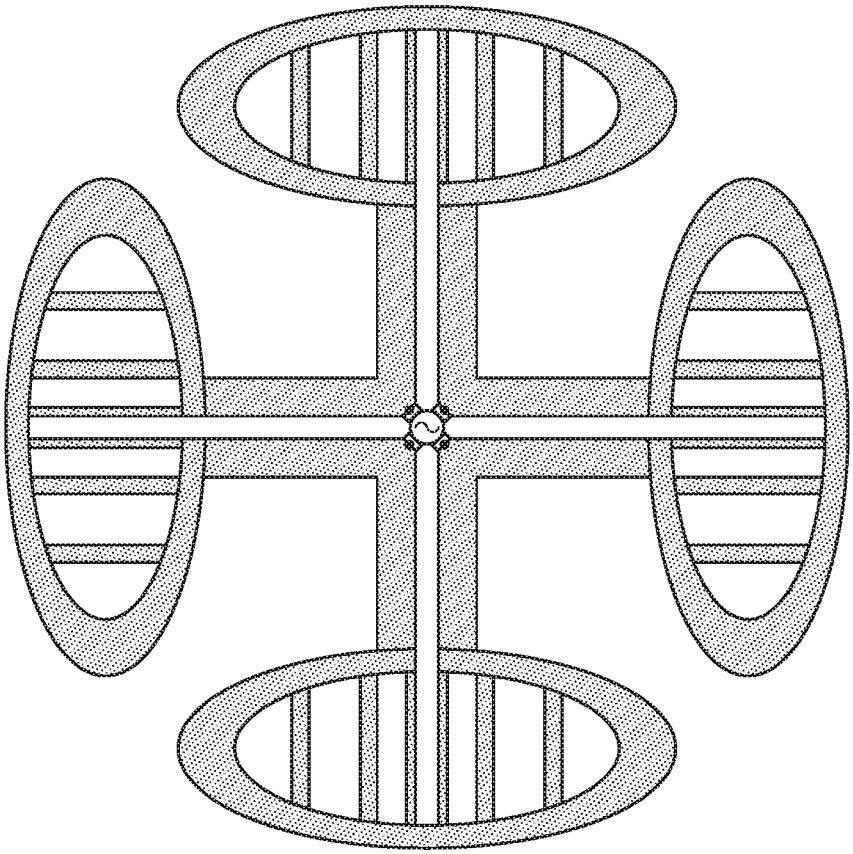
FIG. 8C is a diagram of an antenna structure according to another embodiment of the invention.

According to the embodiments shown in FIGS. 1 to 7, each loop structure 140 substantially has a pentagonal shape (with a larger width at its outer periphery and a smaller width at its inner periphery), and each looped region 145 substantially has a diamond-shape, but the invention is not limited thereto. FIG. 8A is a diagram of an antenna structure 810 according to another embodiment of the invention. In the embodiment of FIG. 8A, each loop structure of the antenna structure 810 substantially has a larger rectangular shape, and each looped region of the antenna structure 810 substantially has a smaller rectangular shape. FIG. 8B is a diagram of an antenna structure 820 according to another embodiment of the invention. In the embodiment of FIG. 8B, each loop structure of the antenna structure 820 substantially has a larger triangular shape, and each looped region of the antenna structure 820 substantially has a smaller triangular shape. FIG. 8C is a diagram of an antenna structure 830 according to another embodiment of the invention. In the embodiment of FIG. 8C, each loop structure of the antenna structure 830 substantially has a larger elliptical shape, and each looped region of the antenna structure 830 substantially has a smaller elliptical shape. According to the practical measurements, the above adjustments of configurations do not affect the performance of the invention. In alternative embodiments, each of the above antenna structures can be fine-tuned to cover a different operation frequency band. For example, the operation frequency band may be from 700 MHz to 960 MHz.

Figure 9:
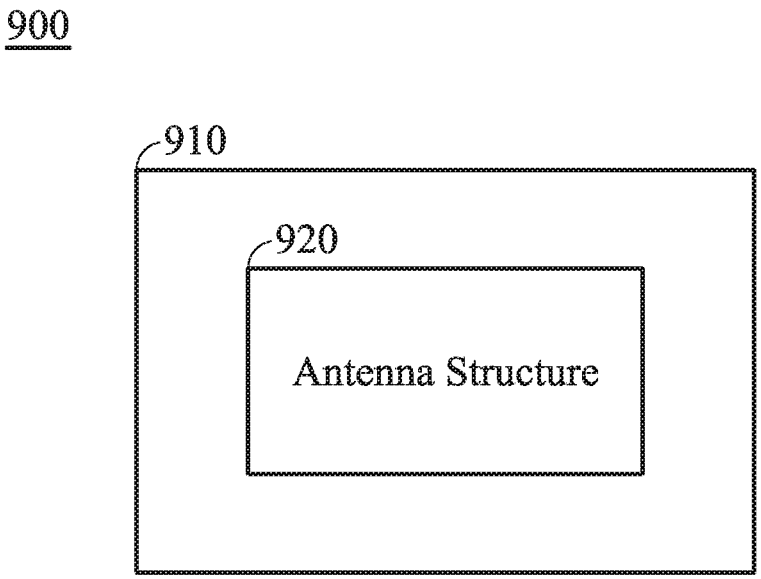
FIG. 9 is a diagram of an electronic device according to an embodiment of the invention.

FIG. 9 is a diagram of an electronic device 900 according to an embodiment of the invention. In the embodiment of FIG. 9, the electronic device 900 includes a housing 910 and an antenna structure 920. The antenna structure 920 is disposed in the housing 910. The housing 910 may be made of a conductive material or a nonconductive material. The shape and type of the housing 910 are not limited in the invention. The antenna structure 920 may be any antenna structure described in the embodiments of FIGS. 1 to 8, and it will not be illustrated again herein.

The invention proposes a novel antenna structure for supporting MIMO (Multi-Input and Multi-Output) functions. In comparison to the conventional design, the proposed antenna structure of the invention has at least the advantages of wide-band, high-gain, dual-polarized, omni-directional, planar, and low-cost characteristics, and therefore it is suitable for application in a variety of high-speed communication devices.

Note that the above element sizes, element shapes, and frequency ranges are not limitations of the invention. An antenna designer can fine-tune these settings or values according to different requirements. It should be understood that the antenna structure and electronic device of the invention are not limited to the configurations of FIGS. 1-9. The invention may merely include any one or more features of any one or more embodiments of FIGS. 1-9. In other words, not all of the features displayed in the figures should be implemented in the antenna structure and electronic device of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of the preferred embodiments, it should be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An antenna structure, comprising:

a signal source;

a first transmission line;

a second transmission line;

a third transmission line;

a fourth transmission line;

a first radiation element, coupled through the first transmission line to the signal source;

a second radiation element, coupled through the second transmission line to the signal source;

a third radiation element, coupled through the third transmission line to the signal source; and a fourth radiation element, coupled through the fourth transmission line to the signal source;

wherein each of the first radiation element, the second radiation element, the third radiation element, and the fourth radiation element comprises:

a loop structure, having a first inner edge and a second inner edge opposite to the first inner edge, and a looped region is formed between the first inner edge and the second inner edge;

a first connection element, extending across a first side of the looped region, and coupled between the first inner edge and the second inner edge; and a second connection element, extending across a second side of the looped region, and coupled between the first inner edge and the second inner edge, wherein the second side is opposite to the first side, and the first connection element and the second connection element are symmetrically positioned;

wherein a first opening is formed and surrounded by the loop structure and the first connection element, and a second opening is formed and surrounded by the loop structure and the second connection element;

wherein each of the first opening and the second opening is an enclosed opening.

2. The antenna structure as claimed in claim 1, wherein the first radiation element, the second radiation element, the third radiation element, the fourth radiation element, the first transmission line, the second transmission line, the third transmission line, and the fourth transmission line are symmetrically disposed with respect to a central point of the antenna structure.

3. The antenna structure as claimed in claim 1, wherein the antenna structure further comprises:

a dielectric substrate, having the first transmission line, the second transmission line, the third transmission line, the fourth transmission line, the first radiation element, the second radiation element, the third radiation element, and the fourth radiation element disposed thereon.

4. The antenna structure as claimed in claim 3, wherein each of the first radiation element, the second radiation element, the third radiation element, and the fourth radiation element further comprises:

a third connection element, extending across the first side of the looped region, and coupled between the first inner edge and the second inner edge; and a fourth connection element, extending across the second side of the looped region, and coupled between the first inner edge and the second inner edge, wherein the third connection element and the fourth connection element are symmetrically positioned.

5. The antenna structure as claimed in claim 4, wherein the third connection element and the fourth connection element are positioned between the first connection element and the second connection element.

6. The antenna structure as claimed in claim 4, wherein each of the first radiation element, the second radiation element, the third radiation element, and the fourth radiation element further comprises:

a fifth connection element, extending across the first side of the looped region, and coupled between the first inner edge and the second inner edge; and a sixth connection element, extending across the second side of the looped region, and coupled between the first inner edge and the second inner edge, wherein the fifth connection element and the sixth connection element are symmetrically positioned.

7. The antenna structure as claimed in claim 6, wherein the fifth connection element and the sixth connection element are positioned between the third connection element and the fourth connection element.

8. The antenna structure as claimed in claim 6, wherein each of the first connection element, the second connection element, the third connection element, the fourth connection element, the fifth connection element, and the sixth connection element substantially has a straight-line shape.

9. The antenna structure as claimed in claim 6, wherein the first connection element, the second connection element, the third connection element, the fourth connection element, the fifth connection element, and the sixth connection element are separated from and substantially parallel to each other.

10. The antenna structure as claimed in claim 6, wherein the antenna structure covers an operation frequency band which comprises a first resonant frequency, a second resonant frequency, a third resonant frequency, a fourth resonant frequency, and a fifth resonant frequency in a low-to-high order.

11. The antenna structure as claimed in claim 10, wherein the operation frequency band is substantially from 1700 MHz to 2700 MHz, or is substantially from 700 MHz to 960 MHz.

12. The antenna structure as claimed in claim 10, wherein a first resonant path is formed along an outer periphery of the loop structure, and a length of the first resonant path is calculated as follows:

$$L_1 = \frac{c \cdot k}{f_1 \cdot \sqrt[6]{\varepsilon_r}}$$

where "$L_1$" represents the length of the first resonant path, "c" represents speed of light, "$f_1$" represents the first resonant frequency, "$\varepsilon_r$" represents a dielectric constant of the dielectric substrate, and "k" represents a compensation constant from 0.8 to 1.2.

13. The antenna structure as claimed in claim 10, wherein a second resonant path is formed along an inner periphery of the loop structure, and a length of the second resonant path is calculated as follows:

$$L_2 = \frac{c \cdot k}{f_2 \cdot \sqrt[6]{\varepsilon_r}}$$

where "$L_2$" represents the length of the second resonant path, "c" represents speed of light, "$f_2$" represents the second resonant frequency, "$\varepsilon_r$" represents a dielectric constant of the dielectric substrate, and "k" represents a compensation constant from 0.8 to 1.2.

14. The antenna structure as claimed in claim 13, wherein a third resonant path is formed along the first inner edge, the first connection element, the second inner edge, and the second connection element, and a length of the third resonant path is calculated as follows:

$$L_3 = L_2 \cdot \left[1 - \left(\frac{f_3}{f_2} - 1\right) \cdot 2\right] \cdot k$$

where "$L_3$" represents the length of the third resonant path, and "$f_3$" represents the third resonant frequency.

15. The antenna structure as claimed in claim 14, wherein a fourth resonant path is formed along the first inner edge, the third connection element, the second inner edge, and the fourth connection element, and a length of the fourth resonant path is calculated as follows:

$$L_4 = L_3 \cdot \left[1 - \left(\frac{f_4}{f_3} - 1\right) \cdot 4\right] \cdot k$$

where "$L_4$" represents the length of the fourth resonant path, and "$f_4$" represents the fourth resonant frequency.

16. The antenna structure as claimed in claim 15, wherein a fifth resonant path is formed along the first inner edge, the fifth connection element, the second inner edge, and the sixth connection element, and a length of the fifth resonant path is calculated as follows:

$$L_5 = L_4 \cdot \left[1 - \left(\frac{f_5}{f_4} - 1\right) \cdot 8\right] \cdot k$$

where "$L_5$" represents the length of the fifth resonant path, and "$f_5$" represents the fifth resonant frequency.

17. The antenna structure as claimed in claim 10, wherein a distance between any opposite two of the first radiation element, the second radiation element, the third radiation element, and the fourth radiation element are as follows:

$$D_1 = \frac{c \cdot k}{2 \cdot f_c}$$

where "$D_1$" represents the distance, "c" represents speed of light, "$f_c$" represents a central frequency of the operation frequency band, and "k" represents a compensation constant from 0.8 to 1.2.

18. The antenna structure as claimed in claim 1, wherein the loop structure substantially has a pentagonal shape, a rectangular shape, a triangular shape, or an elliptical shape.

19. The antenna structure as claimed in claim 1, wherein the looped region substantially has a diamond-shape.

20. An electronic device, comprising:

a housing; and an antenna structure, disposed in the housing, wherein the antenna structure comprises:

a signal source;

a first transmission line;

a second transmission line;

a third transmission line;

a fourth transmission line;

a first radiation element, coupled through the first transmission line to the signal source;

a second radiation element, coupled through the second transmission line to the signal source;

a third radiation element, coupled through the third transmission line to the signal source; and a fourth radiation element, coupled through the fourth transmission line to the signal source;

wherein the first radiation element comprises:

a loop structure, having a first inner edge and a second inner edge opposite to the first inner edge with respect to a virtual extension line, wherein the virtual extension line is substantially perpendicular to a central extension axis of the first transmission line, and a looped region is formed between the first inner edge and the second inner edge;

a first connection element, extending across a first side of the looped region, and coupled between the first inner edge and the second inner edge; and a second connection element, extending across a second side of the looped region, and coupled between the first inner edge and the second inner edge, wherein the second side is opposite to the first side, and the first connection element and the second connection element are symmetrically arranged with respect to the central extension axis of the first transmission line;

wherein a first opening is formed and surrounded by the loop structure and the first connection element, and a second opening is formed and surrounded by the loop structure and the second connection element;

wherein each of the first opening and the second opening is an enclose opening.

* * * * *